US008768193B2

(12) United States Patent
Sugiura

(10) Patent No.: US 8,768,193 B2
(45) Date of Patent: Jul. 1, 2014

(54) FIXING APPARATUS AND IMAGE FORMING APPARATUS THAT SWITCHES FIXING OPERATION

(75) Inventor: Takashi Sugiura, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 203 days.

(21) Appl. No.: 13/267,991

(22) Filed: Oct. 7, 2011

(65) Prior Publication Data

US 2012/0093533 A1 Apr. 19, 2012

(30) Foreign Application Priority Data

Oct. 13, 2010 (JP) ..... 2010-230495

(51) Int. Cl.
*G03G 15/20* (2006.01)

(52) U.S. Cl.
USPC ..... 399/69; 399/43

(58) Field of Classification Search
USPC ..... 399/69, 43, 82
See application file for complete search history.

(56) References Cited

U.S. PATENT DOCUMENTS 5,621,511 A * 4/1997 Nakayama ..... 399/44
6,160,974 A * 12/2000 Yoshikawa et al. ..... 399/68
6,466,751 B1 * 10/2002 Kawano ..... 399/68
2004/0190924 A1 * 9/2004 Iwasaki et al. ..... 399/68
2005/0019050 A1 * 1/2005 Umezawa ..... 399/69
2011/0229180 A1 * 9/2011 Saito ..... 399/69

FOREIGN PATENT DOCUMENTS

JP 60-220365 A 11/1985
JP 10-282836 A 10/1998
JP 2004029129 A * 1/2004
JP 2007-183686 A 7/2007

OTHER PUBLICATIONS

Japanese Office Action for corresponding JP 2010-230495, mail date Apr. 8, 2014.

* cited by examiner

*Primary Examiner* — Quana M Grainger
(74) *Attorney, Agent, or Firm* — Rossi, Kimms & McDowell LLP

(57) ABSTRACT

A fixing apparatus capable of reducing deterioration in productivity while preventing a fixing roller from being heated to a high temperature. The fixing roller has a heating unit incorporated therein, and a rotatable pressurization roller abuts on the fixing roller. A thermistor detects a surface temperature of the fixing roller. A fixing operation is controlled by selectively switching between a first mode and a second mode in which the number of sheets subjected to fixing per unit time is smaller than in the first mode. One of the first and second modes is selected based on a first temperature detected by the thermistor at a first time, a second temperature detected by the thermistor at a second time, and a minimum temperature of the fixing roller at which the toner image can be fixed.

10 Claims, 6 Drawing Sheets

FIXING APPARATUS AND IMAGE FORMING APPARATUS THAT SWITCHES FIXING OPERATION

BACKGROUND OF THE INVENTION

1. Field of the Invention

The present invention relates to a fixing apparatus that passes a recording material between a fixing roller and a pressurization roller to fix a toner image.

2. Description of the Related Art

In some image forming apparatuses, a down sequence in which, for example, printing speed is decreased or printing interval is widened so as to prevent a decrease in the temperature of a fixing apparatus is performed. For example, regarding a down sequence performed when the temperature of a fixing apparatus has decreased, there has been proposed the technique that the time that elapses before the temperature of the fixing apparatus returns to a fixable temperature is gradually shortened according to the time that elapses after power-on of an image forming apparatus (Japanese Laid-Open Patent Publication (Kokai) No. 2007-183686).

Also, there has been proposed the technique that when the temperature of a fixing roller (heating roller) in an image forming apparatus decreases to a predetermined temperature or lower, it is determined that the temperature of a pressurization roller disposed in opposed relation to the fixing roller has decreased, and the temperature of the fixing roller is uniformly increased (Japanese Laid-Open Patent Publication (Kokai) No. H10-282836).

However, according to technique that the time that elapses before the temperature of the fixing apparatus returns to a fixable temperature as described in Japanese Laid-Open Patent Publication (Kokai) No. 2007-183686, when the power is turned on and off while the fixing apparatus is sufficiently hot, the time required for a down sequence which can originally be short becomes excessively prolonged. As a result, the problem that the productivity of the image forming apparatus deteriorates arises.

Moreover, it may be inappropriate to determine that the temperature of the pressurization roller has decreased based on only an instantaneous temperature status of the fixing roller. For example, problems concerning the fixing apparatus such as temperature increase at an end of the fixing roller or hot offset (double transfer) which occurs when a short sheet is fed in a main scanning direction may arise.

SUMMARY OF THE INVENTION

The present invention provides a fixing apparatus capable of reducing deterioration in productivity while preventing a fixing roller from being heated to an excessively high temperature.

Accordingly, a first aspect of the present invention provides a fixing apparatus that heats and fixes a toner image on a recording material, comprising a fixing roller configured to have a heating unit incorporated therein, a pressurization roller configured to be capable of abutting on the fixing roller and freely rotating, a detection unit configured to detect a surface temperature of the fixing roller, and a control unit configured to control a fixing operation by selectively switching between a first mode and a second mode in which the number of sheets subjected to fixing per unit time is smaller than in the first mode, wherein the control unit controls a fixing operation by selecting one of the first and second modes based on a first temperature detected by the detection unit at a first time, a second temperature detected by the detection unit at a second time, and a minimum temperature of the fixing roller at which the toner image can be fixed.

According to the present invention, deterioration in productivity can be reduced while the fixing roller is prevented from being heated to an excessively high temperature.

Further features of the present invention will become apparent from the following description of exemplary embodiments (with reference to the attached drawings).

DESCRIPTION OF THE EMBODIMENTS

The present invention will now be described in detail with reference to the drawings showing an embodiment thereof.

Figure 1:
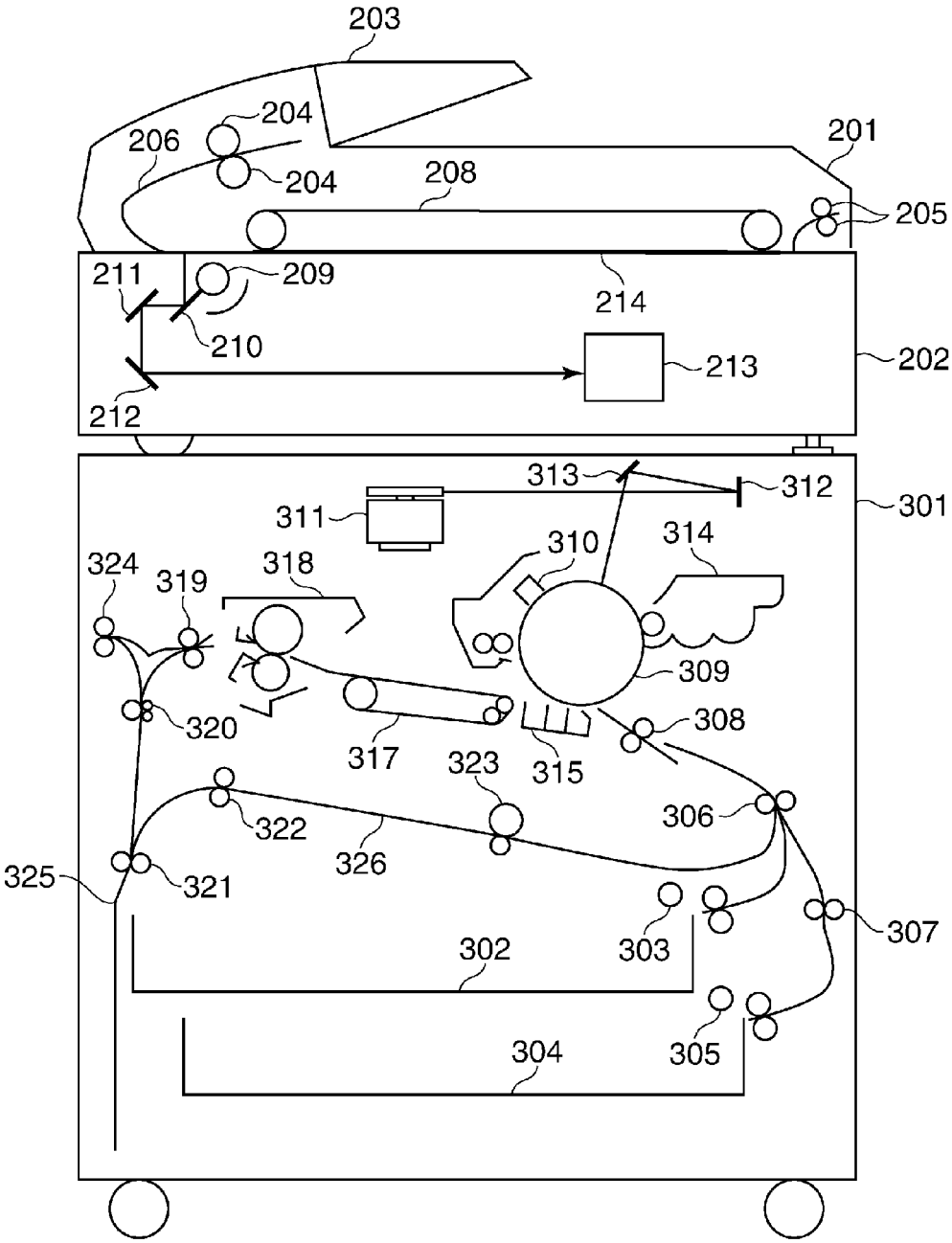
FIG. 1 is a block diagram schematically showing an arrangement of an image forming apparatus to which a fixing apparatus according to an embodiment of the present invention is applied.

FIG. 1 is a block diagram schematically showing an arrangement of an image forming apparatus to which a fixing apparatus according to an embodiment of the present invention is applied. The image forming apparatus, which is configured as a digital copier, has an automatic original feeding unit 201, a reading unit 202, and an image reproducing unit 301.

Originals placed on an original mounting portion 203 of the automatic original feeding unit 201 are separated and fed by sheet feeding rollers 204 and conveyed to the reading unit 202 via a conveying guide 206. Further, each original is conveyed at a constant speed by a conveying belt 208 and discharged from the apparatus by sheet discharging rollers 205. During this time, an image on the original illuminated at a reading position for the reading unit 202 by an illumination system 209 is converted into an image signal, reflected by reflective mirrors 210, 211, and 212, and converted into an image signal by an image reading unit 213.

Although not described in detail in the figure, the image reading unit 213 is comprised of a lens, a CCD which is a photoelectric conversion element, a drive circuit for the CCD, and so on. Original reading modes include a moving original reading mode in which an original is conveyed at a constant speed and read with a reading system kept standstill, and a stationary original reading mode in which an original is mounted on an original platen glass 214 of the reading unit 202 and read while moving at a constant speed through the illumination system 209 and the reflective mirrors 210, 211, and 212. Under normal conditions, sheet-type originals are read in the moving original reading mode, and bound originals are read in the stationary original reading mode.

Image signals obtained as a result of conversion by the image reading unit 213 are subjected to processing by an image processing unit 102 (FIG. 2) and then reproduced on a page-by-page basis on recording sheets, which are recording materials, by the image reproducing unit 301. The image signals are modulated into optical signals by a semiconductor laser (not shown) or the like. The modulated optical signal is exposed on a photosensitive drum 309 uniformly charged by an electrostatic charger 310 via an optical scanning device, which is comprised of a polygon mirror, and mirrors 312 and 313, thus forming an electrostatic latent image. The electrostatic latent image is developed by toner in a developing unit 314, and a toner image is transferred to and formed on a recording sheet by a transfer separation unit 315.

Recording sheets are stored in sheet cassettes 302 and 304. Plain sheets are stored in the sheet cassette 302, and tab sheets, for example, are stored in the sheet cassette 304. A recording sheet (plain sheet) supplied from the sheet cassette 302 is fed by a sheet feeding roller 303, conveyed by conveying rollers 306, and timed to an image by registration rollers 308, and conveyed to a transfer position on the photosensitive drum 309. On the other hand, a recording sheet (tab sheet) in the sheet cassette 304 is fed by a sheet feeding roller 305, conveyed by conveying rollers 307 and 306, timed to an image by the registration rollers 308, and conveyed to a transfer position on the photosensitive drum 309. A recording sheet on which toner images have been transferred is conveyed to a fixing unit (fixing apparatus) 318 by a conveying belt 317, and the fixing unit 318 fixes unfixed toner on the recording sheet.

When a one-sided printing mode is set, a recording sheet from the fixing unit 318 is discharged from the apparatus by fixing sheet discharging rollers 319 and sheet discharging rollers 324. When a both-sided printing mode is set, a recording sheet is conveyed from the fixing sheet discharging rollers 319 to a reversing path 325 by reversing rollers 321 via conveying rollers 320. Further, immediately after a trailing end of the recording sheet passes a point of junction with a both-sided path 326, the recording sheet is reversed by reversing the rotational direction of the reversing rollers 321 and conveyed to the both-sided path 326. The recording sheet conveyed to the both-sided path 326 is conveyed by rollers 322 and 323, and conveyed again by the conveying rollers 306 and timed to an image on the back side by the registration rollers 308. After that, the image is transferred to and fixed on the recording sheet, which in turn is discharged from the apparatus.

When a recording sheet from the fixing unit 318 is to be reversed and discharged from the apparatus, the recording sheet is conveyed once to the conveying rollers 320, and then immediately before a trailing end of the recording sheet passes the conveying rollers 320, the rotational direction of the conveying rollers 320 is reversed, so that the recording sheet is discharged from the apparatus by the sheet discharging rollers 324.

Figure 2:
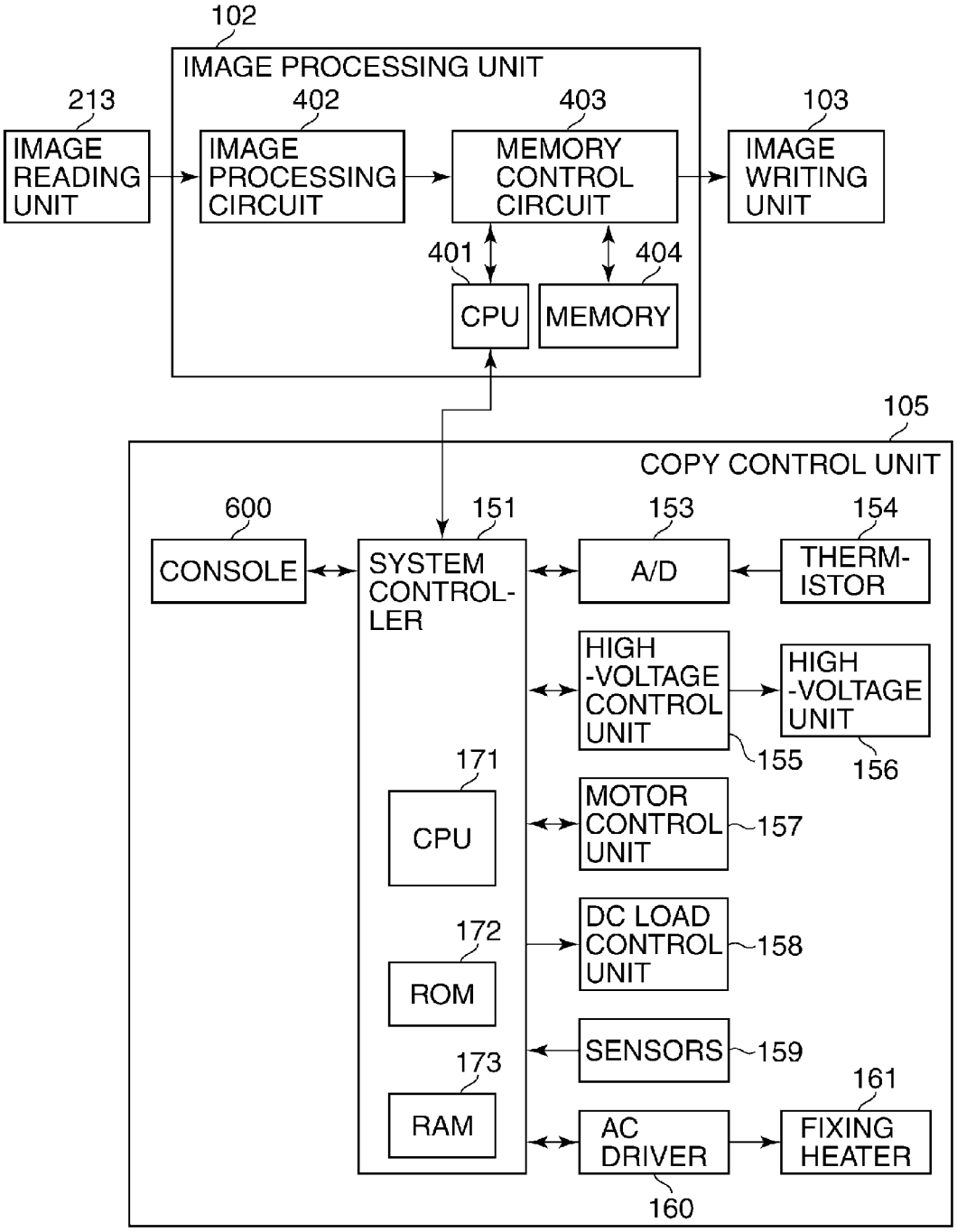
FIG. 2 is a block diagram showing a control mechanism of a digital copier which is the image forming apparatus according to the present embodiment.

FIG. 2 is a block diagram showing a control mechanism of the digital copier according to the present embodiment. The image processing unit 102 is connected to a copy control unit 105.

First, image data read by the image reading unit 213 is input to the image processing unit 102. The image data is subjected to predetermined image processing by an image processing circuit 402 in the image processing unit 102, and then input to a memory control circuit 403. Under the control of a CPU 401, the memory control circuit 403 stores the input image data in a memory 404, and also reads image data, which is to form an image, from the memory 404 and outputs the same to an image writing unit 103.

The CPU 401 controls the memory control circuit 403 so as to store input image data in the memory 404, and output image data stored in the memory 404 to the image writing unit 103. The CPU 401 further reads image data stored in the memory 404, detects an image region where there is image data which is to actually form an image within image data of one page, and notifies the copy control unit 105 of the detected image region.

The copy control unit 105 is subjected to centralized control by a system controller (a counting unit and a control unit) 151. The system controller 151 mainly collects and analyzes information about loads on various components and information about sensors 159. The system controller 151 further exchanges data with the image processing unit 102 to exchange data with a consol 600 which is a user interface.

The system controller 151 has a CPU 171, a ROM 172, and a RAM 173 so as to carry out the processes described above. The system controller 151 also has a thermistor (detection unit) 154 connected thereto via an A/D converter 153, and has a high-voltage control unit 155 for controlling a high-voltage unit 156. The system controller 151 also has a motor control unit 157, a DC load control unit 158, and the above-mentioned sensors 159 connected thereto, and also has a fixing heater 161 connected thereto via an AC driver 160.

The CPU 171 performs various sequences relating to image formation sequences determined in advance in accordance with programs stored in the ROM 172. On this occasion, rewritable data required to be temporarily or permanently stored is stored in the RAM 173. The RAM 173 stores, for example, high-voltage setting values for the high-voltage control unit 155, various data, to be described later, and information on image formation instructions from the consol 600.

The system controller 151 transmits specification setting value data for various components required by the image processing unit 102, and in addition, receives signals from various components, for example, original image density signals. Based on those signals, the system controller 151 configures settings so as to form optimum images by controlling the high-voltage control unit 155 and the image processing unit 102.

The system controller 151 obtains, from the console 600, information on copy magnification, density setting value, and so on set by a user. In addition, the system controller 151 transmits, to the console 600, data such as a state of the image forming apparatus, for example, information on the number of images to be formed, whether or not an image is being formed, whether or not a jam has occurred, a position at which the jam has occurred to show the user.

Figure 3:
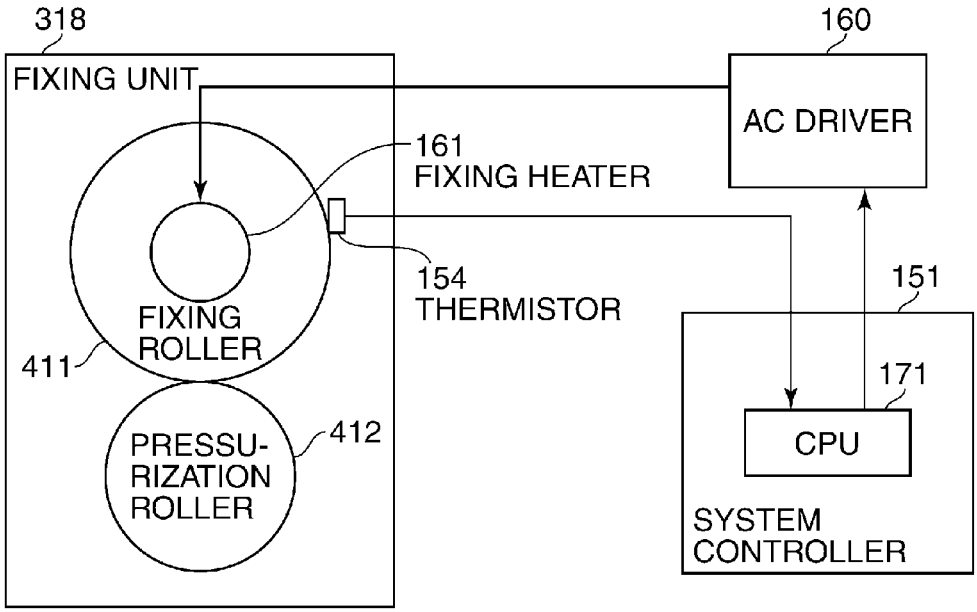
FIG. 3 is a diagram schematically showing an arrangement of a fixing unit and an arrangement of a control mechanism therefor.

FIG. 3 is a diagram schematically showing an arrangement of the fixing unit 318 and an arrangement of a control mechanism for the fixing unit 318.

In the fixing unit 318, a fixing roller 411 and a pressurization roller 412 disposed in opposed relation to the fixing roller 411 are disposed. The fixing roller 411 has the fixing heater 161, which is a heating unit (heat source), incorporated therein. The pressurization roller 412, which is rotatably disposed, is brought into urging contact with the fixing roller 411 by a pressurization spring and so on, not shown, and rotates in a manner following the rotation of the fixing roller 411. By passing a recording sheet with an unfixed toner image formed thereon between the fixing roller 411 and the pressurization roller 412, the toner image is thermally melted and fixed on the recording sheet by pressure of both rollers.

The surface temperature of the fixing roller 411 is detected by the thermistor 154, and the CPU 171 (FIG. 2) of the system controller 151 is notified of the detected surface temperature.

Based on the temperature (detected temperature T) detected by the thermistor 154, the CPU 171 determines whether or not to heat the fixing roller 411, and upon determining to heat the fixing roller 411, the CPU 171 controls the AC driver 160 to drive the fixing heater 161.

Figure 4:
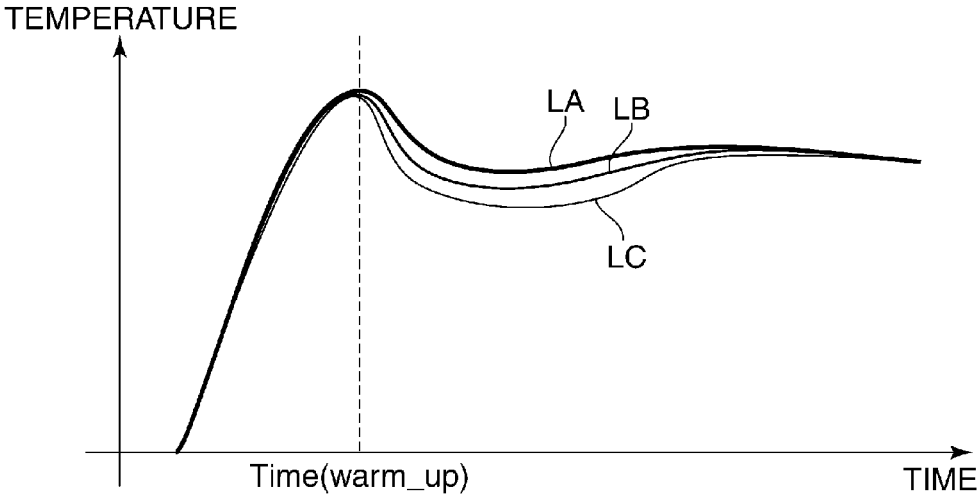
FIG. 4 is a diagram showing changes in the temperature of a fixing roller.

FIG. 4 is a diagram showing changes in the temperature of the fixing roller 411. This figure shows temporal changes in the temperature of the fixing roller 411 in a case where the fixing unit 318 shifts its operational state from a cold state to a power-on→warm-up→standby→print starting. The horizontal axis represents elapsed time Time, and the vertical axis represents detected temperature T of the fixing roller 411 detected by the thermistor 154.

Changes in the temperature of the fixing roller 411 at the time of transition from warm-up to printing also depend on the initial temperature (temperature at the start of printing) of the pressurization roller 412. The degree of decrease in the temperature of the fixing roller 411 after warm-up varies according to the temperature of the pressurization roller 412. A description of how that happens is given. Curves LA, LB, and LC in FIG. 4 are transition curves of the temperature of the fixing roller 411 in cases where the initial temperature of the pressurization roller 412 is relatively high, intermediate, and low, respectively.

When the power to the digital copier according to the present embodiment is turned on, warm-up is started. The fixing roller 411 is heated by the fixing heater 161 from a low temperature to a predetermined temperature. The fixing roller 411 lies in a warmed-up state till "Time (Warm_up)" in a time axis, and after that, a print job is executed. During warm-up, the fixing heater 161 heats the air inside the fixing roller 411, and the pressurization roller 412 is also heated. Further, during the execution of the print job, a recording sheet passing between the fixing heater 161 and the pressurization roller 412 is taking heat.

Figure 5B:
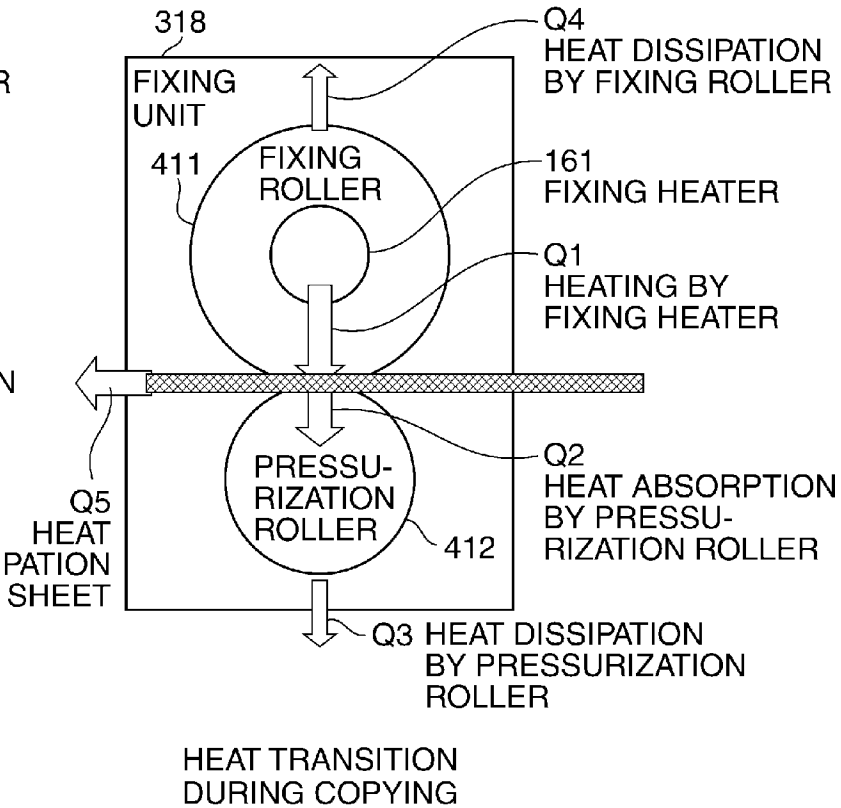
FIGS. 5A and 5B are diagrams schematically showing heat transition in the fixing unit.
Figure 5A:
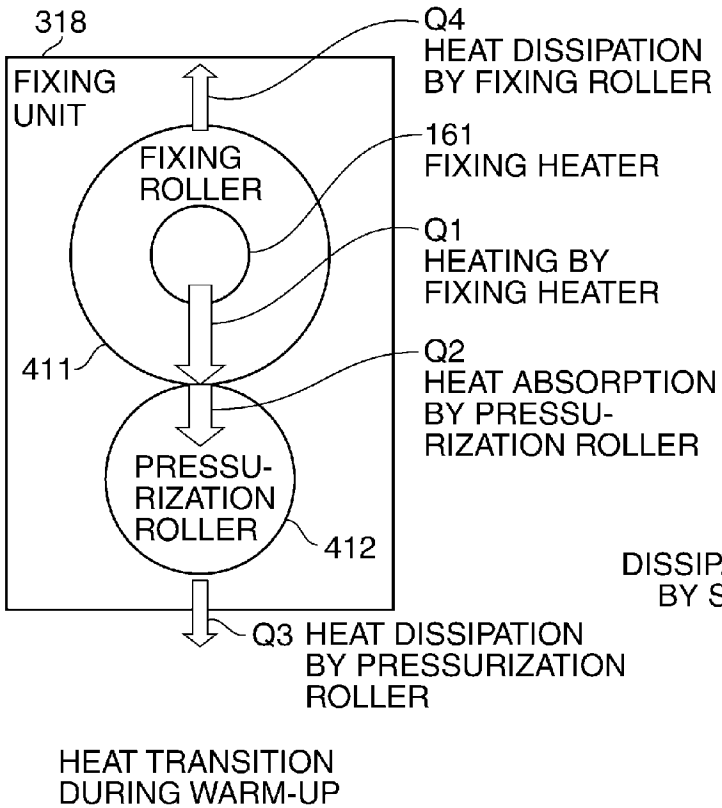

FIGS. 5A and 5B are diagrams schematically showing heat transition in the fixing unit 318. FIG. 5A shows heat transition at the time of warm-up, and FIG. 5B shows heat transition at the time of copying (printing).

In FIGS. 5A and 5B, the quantity of heat Q that goes in and out is defined as follows:

Q1: the quantity of heat generated by the fixing heater 161

Q2: the quantity of heat absorbed from the fixing heater 161 by the pressurization roller 412

Q3: the quantity of heat dissipated by the pressurization roller 412

Q4: the quantity of heat dissipated by the fixing roller 411

Q5: the quantity of heat taken from the fixing roller 411 and the pressurization roller 412 by a recording sheet First, at the time of warm-up, the relationship Q1>Q2+Q3+Q4 always is held because no recording sheet passes. Also, the speed at which temperature rises at the time of warm-up is determined by the quantity of heat calculated using the following expression, Q1−(Q2+Q3+Q4). Moreover, at the time of warm-up, the quantity of heat Q2 absorbed by the pressurization roller 412 varies according to the quantity of heat accumulated in the pressurization roller 412. Namely, when the temperature of the pressurization roller 412 is low, the quantity of heat Q2 is large, but when the temperature of the pressurization roller 412 is high, the quantity of heat Q2 is small.

On the other hand, at the time of copying after the completion of warm-up, the relationship between Q1 and Q2 to Q5 varies according to whether or not the pressurization roller 412 is hot. For example, when the pressurization roller 412 is not hot, the relationship Q1<Q2+Q3+Q4+Q5 is held. As in the case of warm-up, the quantity of heat Q2 absorbed by the pressurization roller 412 varies according to the quantity of heat accumulated in the pressurization roller 412, and the higher the temperature of the pressurization roller 412, the smaller the quantity of heat Q2. Thus, the temperature of the fixing roller 411 decreases until the pressurization roller 412 becomes hot, and in particular, the temperature of the fixing roller 411 decreases whenever a recording sheet passes during a fixing operation.

On the other hand, when the pressurization roller 412 has become sufficiently hot, the relationship Q1>Q3+Q4+Q5 is held because the quantity of heat Q2 absorbed by the pressurization roller 412 is approximately zero. Namely, it becomes unnecessary to supply heat to the pressurization roller 412, and the temperature of the fixing roller 411 gradually recovers. In the state where the relationship Q1>Q3+Q4+Q5 is held, the CPU 171 controls the temperature of the fixing roller 411 to a predetermined temperature based on the detected temperature T detected by the thermistor 154. As a result, the state changes to a state where the relationship Q1=Q3+Q4+Q5 is held, and a state of equilibrium is achieved.

Thus, as shown in FIG. 4, after the completion of warm-up, the temperature of the fixing roller 411 temporarily decreases, and then increases to become stable. The lowest temperature reached by the fixing roller 411 as a result of a fixing operation during copying is defined as "the lowest point Tmin". Based on the mechanism described above, the lowest point Tmin varies according to the initial temperature of the pressurization roller 412 at the start of printing, and the lower the initial temperature, the lower the lowest point Tmin.

Figure 6:
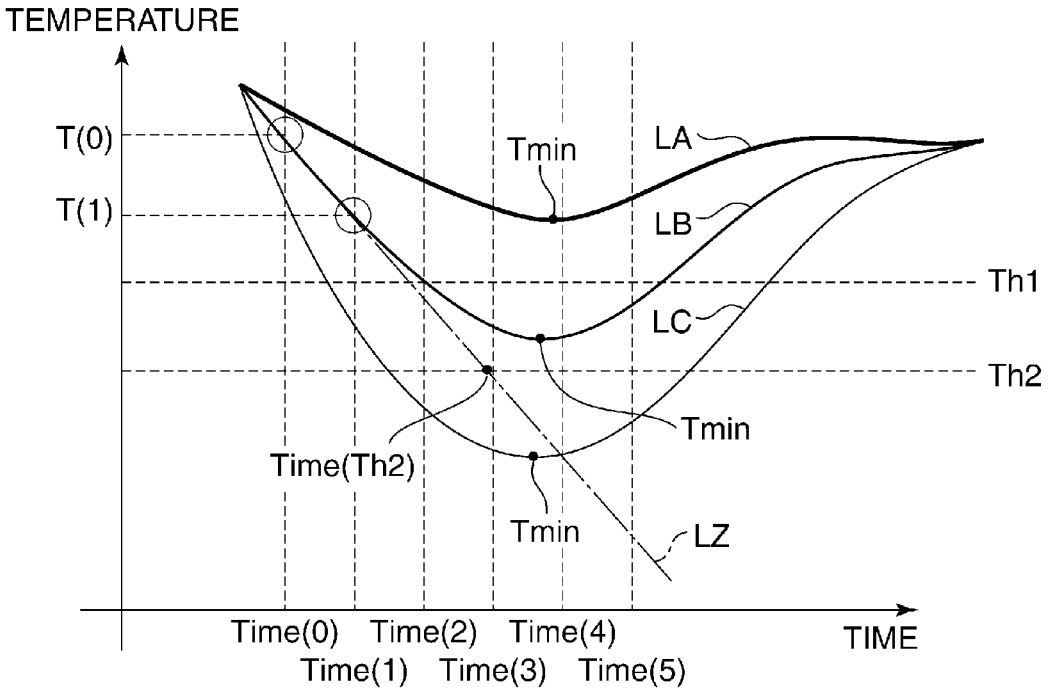
FIG. 6 is a diagram showing changes in the temperature of the fixing roller after the start of a fixing operation.

FIG. 6 is a diagram showing changes in the temperature of the fixing roller 411 after the start of a fixing operation. In particular, FIG. 6 is an enlarged view showing the lowest point Tmin and its vicinity. FIG. 6 is viewed in the same way as FIG. 4. In FIG. 6, Time(x) in the time axis, for example, Time(0) to Time (5) designate times around a fixing operation performed on one recording sheet from the lapse of Time (warm_up) in FIG. 4 onward.

As described earlier, the quantity of heat Q2 absorbed by the pressurization roller 412 depends on the temperature of the pressurization roller 412. This means that the pressurization roller 412 has heat capacity (in J/K). The lowest point Tmin of the fixing roller 411 is determined by the heat capacity of the pressurization roller 412, the quantity of heat accumulated in the pressurization roller 412, and the quantity of heat absorbed by the pressurization roller 412. In other words, the lowest point Tmin of the fixing roller 411 varies according to whether the temperature of the pressurization roller 412 is high or low. Moreover, the quantity of heat absorbed by the pressurization roller 412 is determined by the heat capacity of the pressurization roller 412 and the quantity of heat accumulated in the pressurization roller 412, and hence the time that elapses before the lowest point Tmin is reached is almost constant. In the present embodiment, these characteristics are used.

A down sequence shift temperature Th1 in FIG. 6 is a threshold value of temperature at which control shifts to a down sequence according to the conventional way of control. A fixable minimum temperature Th2 is a minimum temperature of the fixing roller 411 required to properly fix an unfixed toner image formed on a recording sheet and ensure desired fixing characteristics. The down sequence shift temperature Th1 is set to be higher than the fixable minimum temperature Th2.

According to the conventional method of controlling a fixing operation, the temperature of the fixing roller 411 is inhibited from becoming lower than the fixable minimum temperature Th2. Namely, when the temperature of the fixing roller 411 becomes equal to or lower than the down sequence shift temperature Th1, control shifts to a down sequence. The down sequence is executed by stopping a printing operation or widening time intervals between printing operations.

However, because the lowest point Tmin varies according to the quantity of heat accumulated in the pressurization roller 412 as described above, the conventional way of control may be inappropriate. In the example shown in FIG. 6, the lowest point Tmin of the curve LC is lower than the fixable minimum temperature Th2, but the lowest points Tmin of the curves LA and LB are not lower than the fixable minimum temperature Th2. However, according to the conventional way of control, both of the curves LB and LC are lower than the down sequence shift temperature Th1, a down sequence is performed. A down sequence is actually required in the case of the curve LC which is lower than the fixable minimum temperature Th2, and a down sequence is not required in the case of the curve LB.

In the present embodiment, after the start of printing, the CPU 171 controls a fixing operation by selectively switching the fixing mode between a normal first mode and a second mode in which the number of sheets subjected to fixing per unit time is smaller than in the first mode. The first mode is a mode that maintains fixing efficiency, and the second mode is a mode that gives priority to performing a down sequence to supply heat to the pressurization roller 412 through the fixing roller 411.

Although described later in detail with reference to FIG. 7, the CPU 171 selects the fixing mode based on two detected temperatures T detected by the thermistor 154 at different times straddling a fixing operation on a recording sheet and the fixable minimum temperature Th2. The CPU 171 selects the first mode at the start of a fixing operation. Further, the CPU 171 calculates "the number of fixable sheets X" which is a predicted value of the maximum number of sheets on which toner can be fixed without the temperature of the fixing roller 411 becoming lower than the fixable minimum temperature Th2. Then, when the number of sheets on which toner is fixed (the number of fed sheets P) after the start of the fixing operation reaches the number of fixable sheets X, the fixing mode is switched from the first mode to the second mode. As a result, the likelihood that an unnecessary down sequence will be performed can be minimized. Referring to a flowchart, a description will now be given of how fixing is controlled.

Figure 7:
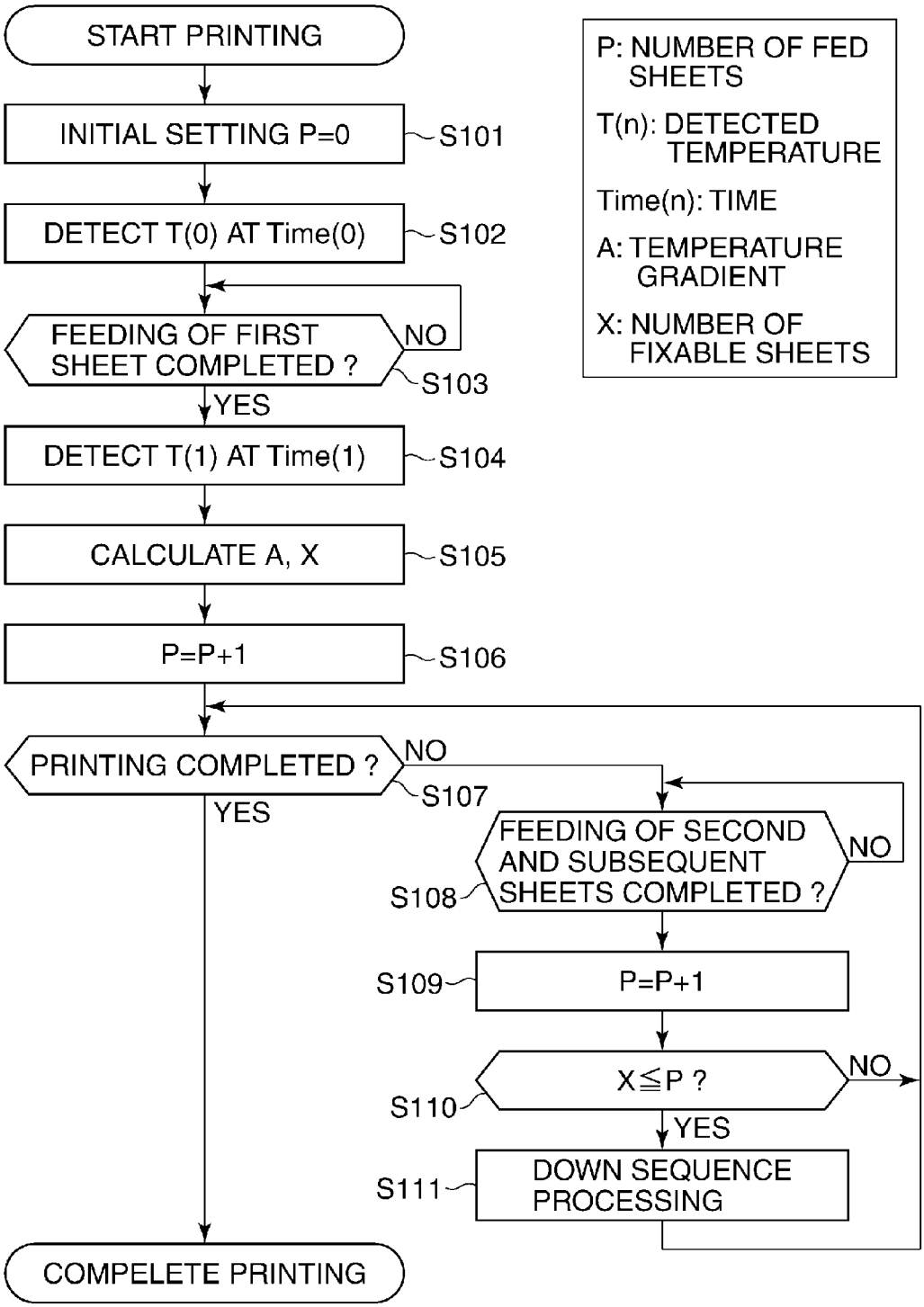
FIG. 7 is a flowchart showing how fixing is controlled during the execution of a print job.

FIG. 7 is a flowchart showing how fixing is controlled when a print job is executed. This process is carried out by the system controller 151 when execution of a print job is instructed.

In FIGS. 6 and 7, Time(n) is a time after a fixing operation on a recording sheet is performed n times (after recording sheets as corresponding in number to the number of fed sheets P are fed). Thus, Time(0) is a time immediately after a print job is started and before a fixing operation on a recording sheet is started. Specifically, Time(0) is a time after the lapse of a predetermined short time period determined in advance since a print job is started. Time(1) is a time immediately after a fixing operation on a recording sheet is carried out. Detected temperature T(n) is a value detected by the thermistor 154 at a time Time (n).

It should be noted that during control using a linear function according to the present embodiment (to be described later), it is unnecessary to use detected temperatures T obtained from Time(2) onward, and hence it is unnecessary to detect temperatures themselves from detected temperature T(2) on down.

Referring to FIG. 7, when printing is started, the CPU 171 of the system controller 151 makes initial settings (step S101). Here, the number of fed sheets P is reset to zero. Then, the CPU 171 loads a detected temperature T detected by the thermistor 154 at a time Time(0) as a detected temperature T(0) into the RAM 173 (FIG. 2).

Then, the CPU 171 determines whether or not feeding of the first recording sheet to the fixing unit 318 has been completed in the present print job (step S103). Namely, to count the number of fed sheets P which is the number of sheets on which toner is fixed after the start of a fixing operation, first, the CPU 171 determines whether or not a fixing operation on one recording sheet has been completed. The CPU 171 continuously carries out the determination, and when feeding of the first recording sheet has been completed, the CPU 171 proceeds to step S104 in which it loads a detected temperature T detected by the thermistor 154 at a time Time(1) as a detected temperature T(1) into the RAM 173.

Then, in step S105, the CPU 171 calculates a temperature gradient A and the number of fixable sheets X based on the detected temperatures T(0) and T(1), the times Time(0) and Time(1), and the fixable minimum temperature Th2 taken in as described above. The temperature gradient A is the degree of change in the temperature of the fixing roller 411. In the present embodiment, the temperature gradient A and the number of fixable sheets X are obtained using a mathematical expression 1 which is a linear function and a mathematical expression 2 given below.

$$y=Ax+b \qquad \text{[Mathematical Expression 1]}$$

$$A=\{T(1)-T(0)\}/\{\text{Time}(1)-\text{Time}(0)\} \qquad \text{[Mathematical Expression 2]}$$

In the mathematical formula 1, temperature T of the fixing roller 411 and elapsed time Time correspond to "y" and "x". The temperature gradient A is the gradient of a straight line, and "b" is a constant determined by performing a computation. The temperature gradient A is calculated using the above mathematical expression 2. The constant b is determined by substituting the calculated temperature gradient A and the detected temperature T(0) and the time Time(0) or the detected temperature T(1) and the time Time(1) into the mathematical expression 1. As a result, the linear function of the mathematical expression 1 is uniquely determined.

On the other hand, the intervals between adjacent times Time are substantially uniform. Thus, the number of fixing operations to be performed until the temperature T of the fixing roller 411 becomes lower than the fixable minimum temperature Th2 can be estimated based on the determined linear function of the above mathematical expression 1 and the fixable minimum temperature Th2.

This will now be explained taking the curve LB as an example with reference to FIG. 6. A straight line LZ passing through two points at coordinates {Time(0), T(0)} and coordinates {Time(1), T(1)} corresponds to the linear function of the above mathematical expression 1. It can be found that the position of an intersection point Time (Th2) of the straight line LZ and the fixable minimum temperature Th2 in a time axis lies between the time Time(3) and the time Time(2). Thus, it is assumed that between feeding of the second sheet and feeding of the third sheet, the temperature T of the fixing roller 411 becomes lower than the fixable minimum temperature Th2. For this reason, it can be determined that the number of fixable sheets X is "2".

When the temperature gradient A and the number of fixable sheets X are thus determined, the CPU 171 proceeds to step S106 in which it increments the number of sheets to be fed P (P=P+1), and determines whether or not printing has been completed (step S107). When printing has been completed, the process in FIG. 7 is brought to an end, but when printing has not been completed yet, the CPU 171 proceeds to step S108.

In the step S108, the CPU 171 determines whether or not feeding of the second and subsequent sheets to the fixing unit 318 has been completed. The CPU 171 continuously carries out the determination, and when feeding of the second and subsequent sheets to the fixing unit 318 has been completed, the CPU 171 proceeds to step S109. In the step S109, the CPU 171 increments the number of sheets to be fed P (P=P+1), and determines in the next step S110 whether or not the number of sheets to be fed P has become equal to or more than the number of fixable sheets X (X≤P). Upon determining that X>P, the CPU 171 returns to the step S107, and on the other hand, upon determining that X>P, the CPU 171 proceeds to step S111.

In the step S111, the CPU 171 temporarily switches to the second mode to carry out down sequence processing because if the next fixing operation is carried out in this state, the temperature T of the fixing roller 411 is expected to become lower than the fixable minimum temperature Th2. After that, the CPU 171 proceeds to the step S107.

As down sequence processing carried out in the second mode, the same processing as conventional one may be carried out, and for example, the interval at which recording materials are conveyed is controlled to be wider than in the first mode, or conveyance of recording materials is temporarily stopped as compared to the first mode. There are thus the method that the interval at which sheets are fed is widened and the method that the recovery of the fixing roller 411 to an appropriate temperature is awaited, but this is not limitative. Namely, the second mode has only to be a mode in which the number of sheets subjected to fixing per unit time is smaller than in the first mode. For example, such control that the above-mentioned relationship Q1>Q2+Q3+Q4 is held has only to be performed for an appropriate period of time.

According to the present embodiment, the temperature gradient A and the fixable minimum temperature Th2 are obtained based on two detected temperatures T(0) and T(1) detected at different times Time(0) and Time(1) straddling a fixing operation on one recording material. The first mode is continued until the number of sheets to be fed P reaches the number of fixable sheets X, so that fixing efficiency can be ensured, and printing time can be reduced. On the other hand, when the number of fed sheets P reaches the number of fixable sheets X, switching from the first mode to the second mode is done to carry out down sequence processing, so that a sufficient period of time for which heat is supplied to the fixing roller 411 can be ensured.

As a result, even when temperature becomes lower than the conventional down sequence shift temperature Th1, no down sequence is performed while X>P. Thus, down sequences that do not have to originally performed can be prevented from being performed. Therefore, the fixing roller can be prevented from being heated to an excessively high temperature, and deterioration in productivity can be reduced.

Moreover, because detected values obtained by the thermistor 154 that has conventionally been provided are used in determining whether or not to change fixing modes, a complex arrangement is not needed.

Although in the present embodiment, after the start of a print job, the number of fixable sheets X is calculated, and fixing modes are controlled to be changed, this should not necessarily be carried out whenever a print job is executed. This may be carried out only once after warm-up.

Moreover, the number of sheets fed (fixing operations) between two times Time(0) and Time(1) is not limited to one, but may be two or more.

Further, although in the present embodiment, the first one of two times at which two detected temperatures T are obtained is a time Time(0) before the start of a fixing operation on the first sheet, this is not limitative. The first time may be a time after the start of a fixing operation on the first sheet, for example, a time before the start of a fixing operation on the second sheet.

The number of fixable sheets X may be infinite depending on the calculated temperature gradient A. In this case, a huge constant (for example, 100,000) may be adopted as the number of fixable sheets X. In this case, a determination step of determining whether "X=huge constant?" is provided in FIG. 7 after the determination result is "NO" in the step S107, and when X=huge constant, the process in FIG. 7 is immediately brought to an end so that processing burdens can be reduced.

Although in the present embodiment, the number of fixable sheets X is estimated based on two detected temperatures T, three or more detected temperatures T may be used. In this case, the number of fixable sheets X calculated using two detected temperatures T is updated by recalculation using the newest two detected temperatures T whenever new detected temperatures T as obtained. When the number of fed sheets P becomes equal to or more than the updated newest number of fixable sheets X, the fixing mode should be switched to the second mode.

Although in the present embodiment, a linear function is used to calculate the number of fixable sheets X in the step S105 in FIG. 7, the present invention is not limited to this. For example, a quadratic function such as $y=ax^2+bx+c$ may be used instead of the above-mentioned mathematical expressions 1 and 2. In this case, a parabolic shape of a curve can be roughly known by actual measurement under various conditions before shipment of products, and the above-mentioned quadratic function is obtained as an approximate equation. Accordingly, a is known. However, the vertex of the curve during use of products cannot be uniquely determined, and thus b and c are unknown. b and c are determined from an equation obtained by substituting time Time(0) and detected temperature T(0) into x and y of the above-mentioned quadratic function, and an equation obtained by substituting time Time(1) and detected temperature T(1) into x and y of the above-mentioned quadratic function. As a result, the vertex of the parabola can be known, and hence the number of fixable sheets X can also be found. It should be noted that the vertex of the parabola corresponds to the lowest point Tmin.

It should be noted that the fixing apparatus according to the present invention may be applied to not only digital copiers but also various apparatuses in which toner is thermally fixed.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-230495 filed Oct. 13, 2010, which is hereby incorporated by reference herein in its entirety.

What is claimed is:

1. A fixing apparatus that heats and fixes a toner image on a recording material, the fixing apparatus comprising:

a fixing roller configured to have a heating unit incorporated therein;

a pressurization roller configured to be abuttable on said fixing roller and freely rotating;

a detection unit configured to detect a surface temperature of said fixing roller;

a counting unit configured to count the number of recording materials subjected to fixing; and a control unit configured to control a fixing operation by selectively switching between a first mode and a second mode in which the number of sheets subjected to fixing per unit time is smaller than in the first mode, wherein said control unit controls a fixing operation by selecting one of the first or second modes based on a first temperature detected by said detection unit at a first time, a second temperature detected by said detection unit at a second time, and a minimum temperature of said fixing roller at which the toner image is fixed, and wherein said control unit selects the first mode at the start of the fixing operation, and using the first temperature and the second temperature, calculates the maximum number of recording materials on which the toner image is fixable without the surface temperature of said fixing roller becoming lower than the minimum temperature, and when the number of recording materials subjected to fixing after the start of the fixing operation counted by said counting unit reaches the maximum number, said control unit switches from the first mode to the second mode.

2. A fixing apparatus according to claim 1, wherein using the first temperature and the second temperature, said control unit calculates a gradient of change in the surface temperature of said fixing roller relative to time, and calculates the maximum number based on the calculated gradient.

3. A fixing apparatus according to claim 1, wherein in the second mode, said control unit provides control so that an interval at which the recording material is conveyed is wider than in the first mode.

4. A fixing apparatus according to claim 1, wherein in the second mode, said control unit provides control so that conveyance of the recording material is temporarily stopped as compared to the first mode.

5. A fixing apparatus according to claim 1, wherein the second time is a different time from the first time across a fixing operation on at least one recording material.

6. An image forming apparatus comprising:

an image forming unit configured to form a toner image on a sheet;

a conveying unit configured to convey the sheet on which the toner image has been formed by said image forming unit;

a fixing unit configured to have a first rotating member, a heating unit that heats the first rotating member, and a second rotating member that presses the first rotating member, and fix the toner image on the sheet that has been conveyed by said conveying unit at a nip portion between the first rotating member and the second rotating member;

a temperature detecting unit configured to detect a temperature of the first rotating member;

a controller configured to control the heating unit based on the temperature of the first rotating member detected by said temperature detecting unit;

a determination unit configured to determine the number of sheets passing the nip portion that would take to decrease the temperature of the first rotating member to lower than a threshold temperature based on a first temperature of the first rotating member detected by said temperature detecting unit at a first timing before a predetermined number of sheets pass the nip portion and a second temperature of the first rotating member detected by said temperature detecting unit at a second timing after the predetermined number of sheets passed the nip portion; and a conveyance control unit configured to control said conveying unit, wherein in a case where said conveying unit causes a plurality of sheets, whose number is larger than the predetermined number, to pass the nip portion, said conveyance control unit is configured to control said conveying unit to change from a first conveying mode into a second conveying mode before the number of sheets having passed the nip portion reaches the number of sheets determined by said determination unit, and wherein the number of sheets passing the nip portion during a predetermined time in the second conveying mode is smaller than the number of sheets passing the nip portion during the predetermined time in the first conveying mode.

7. The image forming apparatus according to claim 6, wherein said determination unit updates the determined number of sheets based on a plurality of temperatures including a third temperature detected by said temperature detecting unit at a third timing later than the second timing.

8. The image forming apparatus according to claim 7, wherein the plurality of temperatures include the second temperature and the third temperature.

9. The image forming apparatus according to claim 6, wherein said conveyance control unit causes said conveying unit to stop conveyance of sheets to be conveyed to the nip portion in the second conveying mode.

10. The image forming apparatus according to claim 6, wherein a first interval at which sheets are conveyed to the nip portion in the first conveying mode is narrower than a second interval at which sheets are conveyed to the nip portion in the second conveying mode.

* * * * *